United States Patent [19]

Puleo

[11] 4,291,075

[45] Sep. 22, 1981

[54] BRACKET FOR ARTIFICIAL CHRISTMAS TREE BRANCHES

[76] Inventor: Salvatore J. Puleo, 435 Division St., Elizabeth, N.J. 07201

[21] Appl. No.: 89,562

[22] Filed: Oct. 29, 1979

[51] Int. Cl.[3] ..... A47G 33/06

[52] U.S. Cl. ..... 428/8; 211/196; 211/205; 248/538; 428/20

[58] Field of Search ..... 211/107, 110, 111, 171, 211/172, 196, 205; 428/18; 248/538

[56] References Cited

U.S. PATENT DOCUMENTS

| | | | |
|---|---|---|---|
| 2,708,324 | 5/1955 | Wedden | 428/18 X |
| 2,826,845 | 3/1958 | Warren | 428/20 X |
| 3,115,435 | 12/1963 | Abramson | 428/20 X |
| 3,131,112 | 4/1964 | Abramson | 428/20 X |
| 3,159,523 | 12/1964 | Abramson | 428/8 |
| 3,728,202 | 4/1973 | Baus et al. | 428/12 |
| 4,109,345 | 8/1978 | Sargent et al. | 428/18 X |
| 4,140,823 | 2/1979 | Weskamp | 428/20 X |

FOREIGN PATENT DOCUMENTS

| | | | |
|---|---|---|---|
| 1112518 | 5/1968 | United Kingdom | 211/196 |

*Primary Examiner*—Henry F. Epstein

*Attorney, Agent, or Firm*—Harvey B. Jacobson

[57] ABSTRACT

A bracket for supporting a plurality of artificial tree branches, such as those used to form artificial Christmas trees, from a tree trunk in an angular relation simulative of the natural relationship between a tree trunk and tree branches. The bracket member includes a collar mounted on the tree trunk and a plurality of radially extending, circumferentially spaced arms unitary therewith with each of the arms defining an upwardly opening channel having parallel side walls and an upwardly and outwardly inclined bottom wall for receiving the inner twisted wire end of an artificial Christmas tree branch. One side wall of each arm is provided with a vertical slot therein and the opposite side wall is provided with a lateral projection defining a socket communicating with an opening in the opposite side wall to enable the laterally extending end of the twisted wire end of a Christmas tree branch to be assembled and disassembled with respect to the arm by inserting the offset end into the socket while passing the major portion of the tree branch end through the slot with the tree branch then being pivotally connected to the arm with the inclined bottom of the channel forming a downward limit for the downward swinging movement of the tree branch thereby orienting it in a desired angular relation to the tree trunk and permitting free upward swinging movement of the branches toward a position alongside of the tree trunk.

6 Claims, 4 Drawing Figures

BRACKET FOR ARTIFICIAL CHRISTMAS TREE BRANCHES

BACKGROUND OF THE INVENTION

1. Field of the Invention

The present invention generally relates to a bracket for mounting a plurality of artificial Christmas tree branches to a tree trunk in a manner to maintain the branches in a desired predetermined angular position, enable the branches to swing upwardly toward a position alongside of the trunk to facilitate storage of the artificial Christmas tree when not in use and also enabling assembly and disassembly of the Christmas tree branches with respect to the bracket.

2. Description of Relevant Art

Artificial Christmas trees are being used extensively but one of the problems encountered is the bulkiness of the tree which renders it difficult to transport and store. Various efforts have been made to enable the tree components to be stored in a compact condition to reduce cost of transportation, storage, and the like. Such arrangements include the provision of angular sockets disposed in the tree trunk for removably telescopically receiving offset inner ends of artificial tree branches which are normally constructed of twisted wires securing plastic needles therebetween with the inner ends of the twisted wires being angularly disposed at varying angles depending upon the vertical position of the branch on the tree trunk. While such devices perform satisfactorily, it is time consuming to assemble and disassemble the tree branches with respect to the trunk. Other types of connections have been provided for mounting the tree branches so that they will pivot or swing to a collapsed position so that the tree will occupy less volume. Such devices include various types of hinges which enable free upward swinging movement of the tree branches but limit the downwad swinging movement to a predetermined angular position. The following U.S. patents are exemplary of the relevant art in this field of endeavor: Nos.

2,826,845
3,159,523
4,109,345
3,115,435
3,728,202

SUMMARY OF THE INVENTION

An object of the present invention is to provide a mounting bracket for supporting a plurality of artificial Christmas tree branches from a tree trunk in which the branches are permitted to pivot freely in one direction but are limited in their pivotal movement in an opposite direction by a rigid component on the bracket for retaining the branches in desired angular relation to the tree trunk in their normal operative position but enabling them to be freely pivoted to an upwardly extending position alongside of the tree trunk thereby facilitating collapse of the artificial Christmas tree that is facilitated by inverting the tree trunk so that all of the branches will swing toward a collapsed position alongside of the tree trunk.

Another object of the invention is to provide a bracket in accordance with the preceding object in the form of a collar having a plurality of radially extending, circumferentially spaced arms formed unitarily therewith with each of the arms including spaced parallel vertical walls interconnecting by an upwardly and outwardly inclined bottom wall which provides means for limiting the downward swinging movement of the inner end of a tree branch.

A further object of the invention is to provide a bracket in accordance with the preceding object in which one vertical wall is provided with a vertical slot and the opposite vertical wall is provided with an aperture and socket aligned with the lower end of the slot to enable the inner end of a twisted wire tree branch having a perpendicular end portion to be inserted through the slot into the aperture and then pivoted downwardly to an inclined position where the inner end of the tree branch engages the upper surface of the inclined bottom wall thereby positioning the tree branch in optimum angular relation to the trunk simulative of a natural Christmas tree.

Still another object of the invention is to provide a bracket in accordance with the preceding objects constructed of one piece of material, preferably plastic, which renders the bracket quite inexpensive to manufacture and easy to assemble with respect to a tree trunk. The plastic material having some degree of flexibility but being substantially rigid will enable easy assembly and disassembly of the tree branches while also enabling pivotal movement of the tree branches in one direction towards their collapsed position with the tree branches being securely supported and dependably pivotally and releasably connected with the tree trunk.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
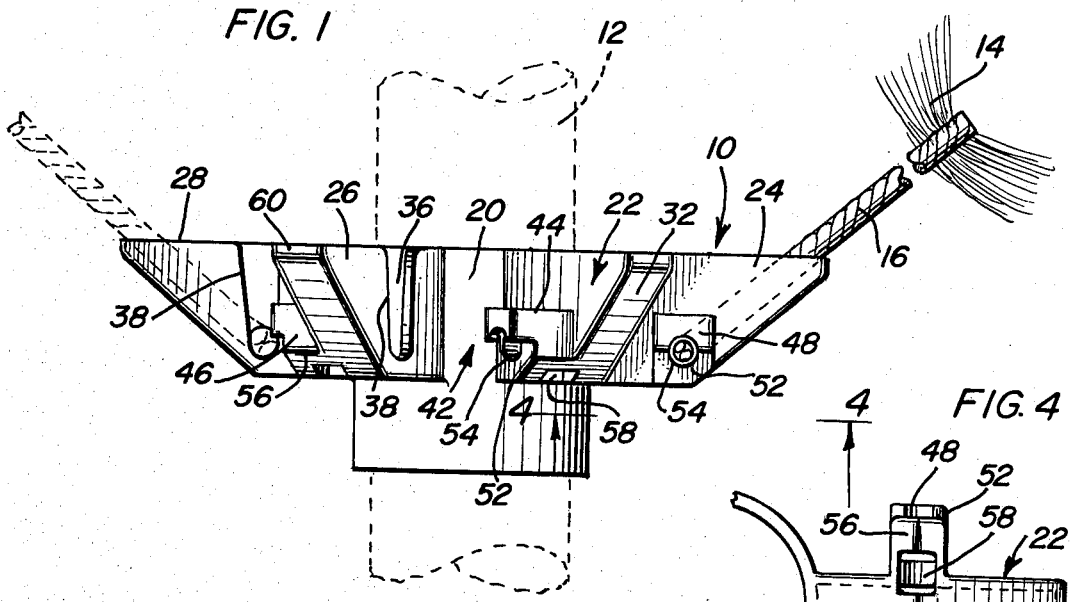
FIG. 1 is a side elevational view of the invention illustrating the association thereof with a tree trunk and the inner ends of artificial Christmas tree branches.

Referring now specifically to the drawings, the bracket of the present invention is generally designated by reference numeral 10 and is illustrated in association with the vertically disposed artificial Christmas tree trunk 12 for supporting a plurality of artificial Christmas tree branches 14 therefrom. The specific structure of the Christmas tree branches 14 is conventional and includes an inner end portion 16 defined by a twisted wire structure with the other details of the tree branch 14 being conventional except that the terminal inner end thereof is laterally offset as at 18 with the laterally offset end portion 18 being perpendicular to the inner end portion 16 as clearly illustrated in FIG. 2.

The bracket 10 includes a vertically disposed collar 20 of annular configuration, preferably cylindrical, disposed on the tree trunk 12 and secured thereto in any suitable manner. Extending radially from the collar or annular member 20 is a plurality of circumferentially spaced arms each of which is generally designated by numeral 22. The arms 22 and the collar 20 are of unitary construction and constructed of plastic material which enables the bracket to be easily molded using conventional plastic molding techniques.

Figure 3:
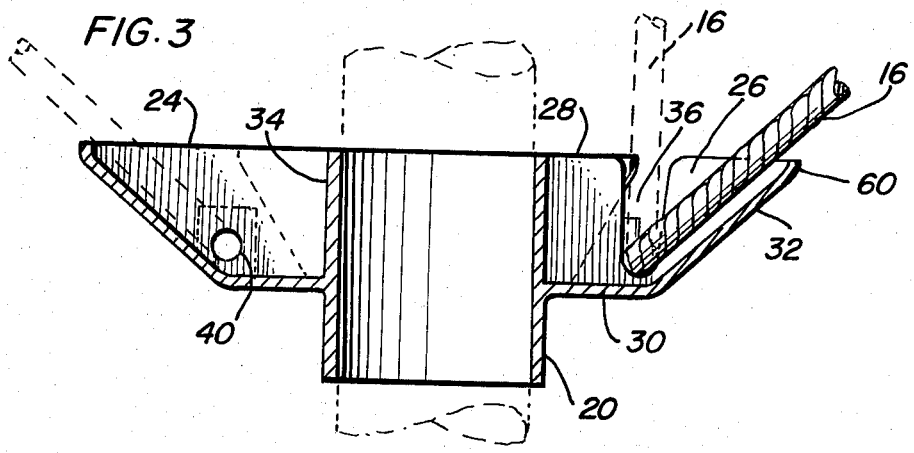
FIG. 3 is a transverse, sectional view taken substantially upon a plane passing along section line 3—3 on FIG. 2 illustrating the specific structural details of the bracket and the association of the inner ends of the Christmas tree branches therewith.

Each arm 22 includes a pair of substantially vartical, parallel side walls 24 and 26 each of which have a straight upper edges 28 and which are interconnected along the bottom edge by a horizontal bottom wall portion 30 and an upwardly and outwardly inclined bottom wall portion 32 as illustrated in FIG. 3. The inner edges of the walls 24 and 26 are unitary with the collar 20 at 34. The arms 22 are preferably equally spaced and the number of arms may vary depending upon the position of the bracket 10 om the tree trunk. For example, a bracket 10 adjacent the lower end of the tree trunk may have more arms to support a larger number of Christmas tree branches than a bracket adjacent the upper end of the tree trunk.

The side wall 26 is provided with a vertically extending slot 36 therein which has an upper end communicating with the top edge 28 of the side wall 26 and a lower end disposed closely adjacent to but spaced slightly above the bottom of the arm 22 as illustrated in FIG. 3, and the side edges of the slot 36 may diverge slightly upwardly with the outermost edge 38 being inclined outwardly and the inner edge being generally vertical as illustrated in FIGS. 1 and 3.

Figure 4:
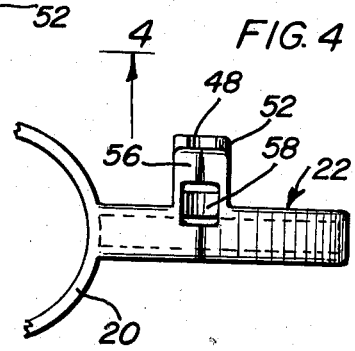
FIG. 4 is a fragmental bottom plan view taken along reference line 4—4 on FIG. 1 illustrating further structural details of the projection and socket formed on one wall of each of the radial arms on the bracket.
Figure 2:
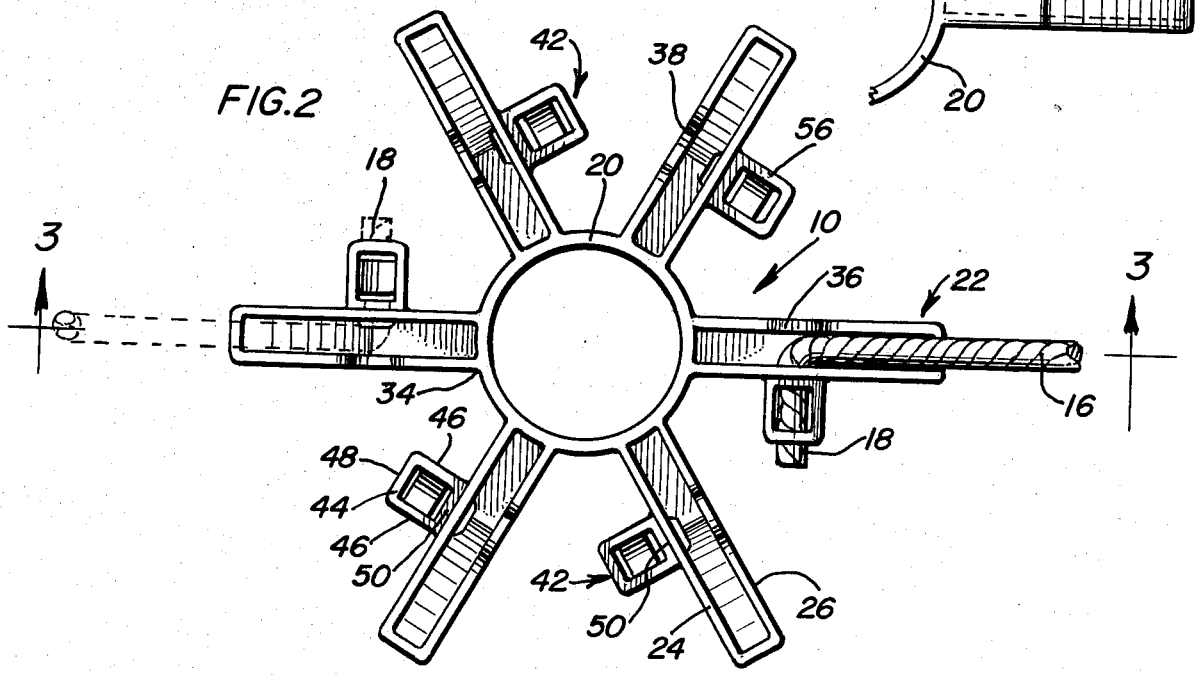
FIG. 2 is a top plan view of the construction of FIG. 1.

The other side wall 24 includes an opening or aperture 40 in alignment with the lower end of the slot 36 with the lower periphery of the opening 40 extending completely to the inner surface of the juncture between the bottom wall portions 30 and 32. Extending laterally from the wall 24 is a hollow projection 42 defined by a relatively flat horizontal top edge 44 of radially spaced parallel vertical walls 46 and an outer vertical wall 48 and an inner vertical wall 50 which actually forms a thickened portion for a small area of the side wall 24 above the opening 40. The outer wall 48 is provided with an inwardly offset lower portion 52 as illustrated in FIGS. 1 and 4, and an aperture 54 extends through the juncture between the portions 48 and 52 of the outer wall with the aperture 54 being in alignment with the aperture 40 in the wall 24 and the lower end portion of the slot 36. The lower end of the projection 42 includes a partial bottom wall 56 which is angulated in coplanar relation with the bottom wall portions 30 and 32 and an opening 58 is provided in the bottom wall portion 56 is bridging relation to the inner wall 50 and the wall 24 as illustrated in FIGS. 2 and 4.

This structure enables the offset end portion 18 of the inner end 16 of the tree branch 14 to be moved vertically downwardly through the slot 36 until it is aligned with the apertures 40 and 54. Then, with the inner end portion 16 of the tree branch oriented in vertical position in alignment with the slot 36 as illustrated in broken line in FIG. 3, the offset end portion 18 can be moved laterally of the arm into and through the openings 40 and 54 to a final position as illustrated in FIG. 2 with the inner end portion 16 of the tree branch then being aligned with the upwardly opening channel defined by the two spaced walls 24 and 26. The tree branch then can be pivoted downwardly and outwardly until the lower surface of the inner end portion 16 of the tree branch engages and rests on the upper surface of the inclined bottom wall portion 32 or a thickened upper edge portion 60 which limits the downward angular movement of the tree branch to a desired angular relation to the tree trunk 12.

The bottom of the slot 36 is generally semi-cylindrical and the top surface of the partial bottom wall 56 is similarly curved and in alignment with the bottom of the slot thereby providing two laterally spaced points of engagement for the lower surface of the offset end portion 18 of the tree branch when the tree branch is assembled therein. Likewise, the upper peripheral portion of the opening 54 defined by the lower edge of the outer end wall 48 and the lower or downwardly facing peripheral surface of the opening 40 in the wall 24 and the inner wall 50 provides a laterally spaced semi-cylindrical bearing engagement with the upper surface of the offset end portion 18 of the tree branch thereby stabilizing the tree branch and providing a secure engagement therewith and also providing passageways enabling any extraneous material to be discharged from the space between the side walls. The projection 42 is actually oriented in a cantilever fashion from the wall 24 and is of unitary construction therewith with the particular arrangement of openings and walls enabling the entire bracket to be of one piece molded plastic construction with the specific structure of the arms including the slot 36 and projection 42 enabling easy and quick assembly and disassembly of the tree branches and and enabling the tree branches to swing from an upwardly inclined position toward a position alongside of the tree trunk by the free swinging movement of the tree branches 14 inwardly toward the tree trunk about a transverse axis defined by the lateral offset end portion 18 of the inner end 16 of the tree branch 14 engaging the spaced bearing surfaces along the bottom surface thereof and along the top surface thereof.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A bracket for mounting artificial tree branches to an artificial tree trunk comprising:

an annular member concentrically and fixedly positionable on said tree trunk;

a plurality of outwardly extending arms on said annular member, said arms being circumferentially spaced on said annular member and rigidly mounted thereto, each of said arms defining an upwardly opening channel for receiving an inner end of an artificial tree branch, said channel being defined by first and second parallel spaced vertical walls interconnected by an upwardly and outwardly inclined bottom wall, said first vertical wall including a generally vertical slot communicating with an upper edge thereof and said second vertical wall including an opening generally in alignment with a lower end portion of the slot for receiving a laterally extending portion of said inner end of said tree branch with said slot enabling the tree branch integral with and adjacent to the laterally extending inner end to be moved into the channel and to be supported by the inclined bottom wall of said channel which serves to limit a downward swinging movement of said artificial tree branch;

means on each arm pivotally supporting the inner end of said tree branch to enable the tree branch to pivot about an axis transverse to the trunk; and means on each arm to limit the downwardly swinging movement of the tree branch so as to position the tree branch in a position which simulates its natural relation to the tree trunk with the tree branch being freely pivotal upwardly to a position alongside the tree trunk.

2. The bracket as defined in claim 1 wherein said second vertical wall includes a projection extending outwardly therefrom in alignment with the opening contained in said second wall, said projection being hollow and being provided with a passageway therethrough to receive the laterally extending inner end of the tree branch.

3. The bracket as defined in claim 2 wherein said hollow projection includes a bottom surface and a top surface cooperating with the opening in said second wall and the lower end portion of the slot in said first wall to rotatably support and stabilize the laterally extending inner end of the tree branch at longitudinally spaced points along the top and bottom surfaces thereof.

4. The bracket as defined in claim 3 wherein the spaced points of support for the top surface of the inner end of the tree branch are longitudinally staggered in relation to the spaced points of support provided by the bottom surface.

5. The bracket as defined in claim 4 wherein said bracket and arms are constructed of a one-piece plastic material with upper edges of said first and second vertical walls being coplanar with an upper end of the annular member, said annular member being cylindrical and having a lower end extending substantially below said arms.

6. The bracket as defined in claim 5 wherein said inclined bottom wall includes a horizontal inner end portion forming a continuation of the inclined bottom wall.

* * * * *